US006096989A

United States Patent [19]

Kinoshita

[11] Patent Number: 6,096,989

[45] Date of Patent: Aug. 1, 2000

[54] VOLUME VARIABLE TYPE SWITCH STRUCTURE

[76] Inventor: Ryohei Kinoshita, 2265-12, Sakahama, Inage-shi, Tokyo, Japan

[21] Appl. No.: 09/257,342

[22] Filed: Feb. 25, 1999

[51] Int. Cl.[7] ..... H01H 13/70

[52] U.S. Cl. ..... 200/345; 341/22; 361/680

[58] Field of Search ..... 200/5 A, 512–517, 200/341, 345; 400/472, 480, 481, 488, 489, 490, 491, 491.2, 492, 495, 495.1; 361/680; 341/22

[56] References Cited

U.S. PATENT DOCUMENTS 5,519,569 5/1996 Sellers ..... 361/680
5,635,928 6/1997 Takagi et al. ..... 341/22
5,850,194 12/1998 Lin ..... 341/22
5,874,696 2/1999 Hayashi et al. ..... 200/5 A

*Primary Examiner*—Michael Friedhofer
*Attorney, Agent, or Firm*—Koda & Androlia

[57] ABSTRACT

A switch formed with a repulsive spring between a key top and a lower contact wherein the switch is provided with a repulsive spring for separating the key top and the lower contact. The switch is horizontally shiftable by a driving board which extends from an adjacent switch and the repulsive spring is shifted by the driving board to allow the key top to fall by the weight of the key top.

10 Claims, 13 Drawing Sheets

VOLUME VARIABLE TYPE SWITCH STRUCTURE

BACKGROUND OF THE INVENTION

1. Field of the Invention

The present invention relates to a keyboard apparatus which can make the height variable.

2. Prior Art

Conventionally, there has been known a keyboard apparatus which can make the intervals and the height of keys variable in a horizontal or vertical direction, however construction of the apparatus was complicated.

SUMMARY OF THE INVENTION

Therefore, the present inventors separated a repulsive spring from a key top and enabled the key top to fall by providing a shift means of the repulsive spring. Specifically, it is a volume variable type switch or the like in which the repulsive spring upwardly abutting against the lower surface of the key top is provided with a protrusion for supporting the key top in a vertical direction as well as a pivot mounting portion at the lower part, and the protrusion and the lower surface of the key top are separated by rotating the pivot mounting portion as a pivotal axis to enable the key top to fall by its own weight. The pivot mounting portion is a cylindrical member rotary about the pivotal axis, is formed with a plurality of grooves in the outer periphery and rotates about the pivotal axis by a cooperation action of a movable member (in the embodiment a member to allow a horizontal shift) to be engaged with the grooves.

EMBODIMENTS

A key top 4 according to the embodiment shown in the figures is formed as a cap shape body having a side wall 4*a*, covers between a supporting wall 6*a* and a supporting wall 6*b* erected from a proximal body, and movably supported in a vertical direction. Further, an intermediate member 9 mounted between the side wail 4*a* and the supporting wall 6*b* for improving the smooth movement and reducing the overlapping length.

On the other hand, a repulsive spring 5 is formed as a Z-shape metallic elastic part, has a spherical protrusion 5*a* at the extreme end, and allows the extreme end of the protrusion 5*a* to abut against the back face of the key top and push up to the maximum height when being positioned in a predetermined state on the proximal body.

Figure 2:
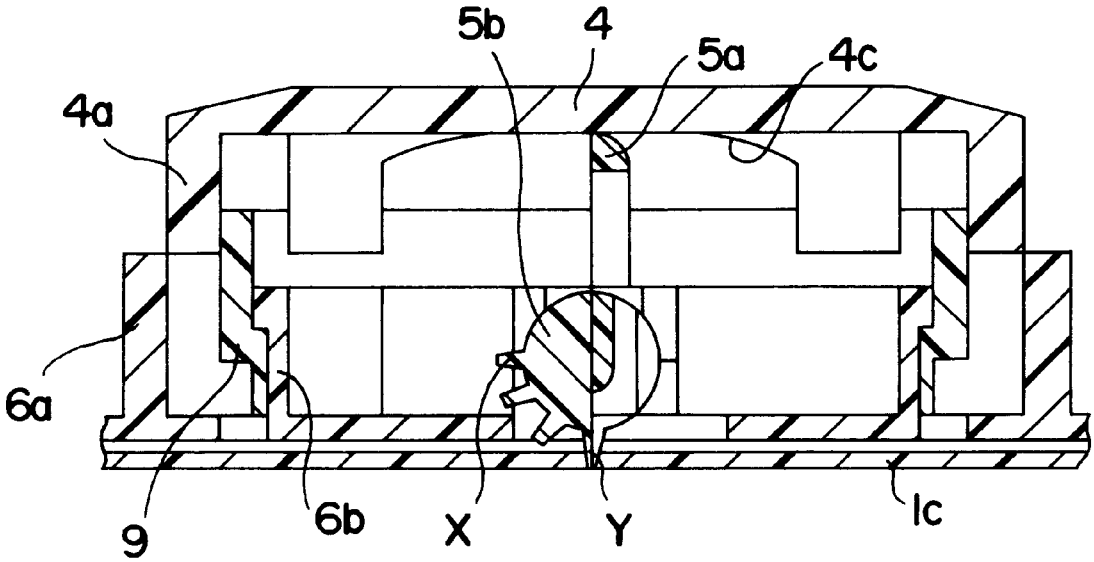
FIG. 2 is a sectional view of a switch according to an embodiment.
Figure 9:
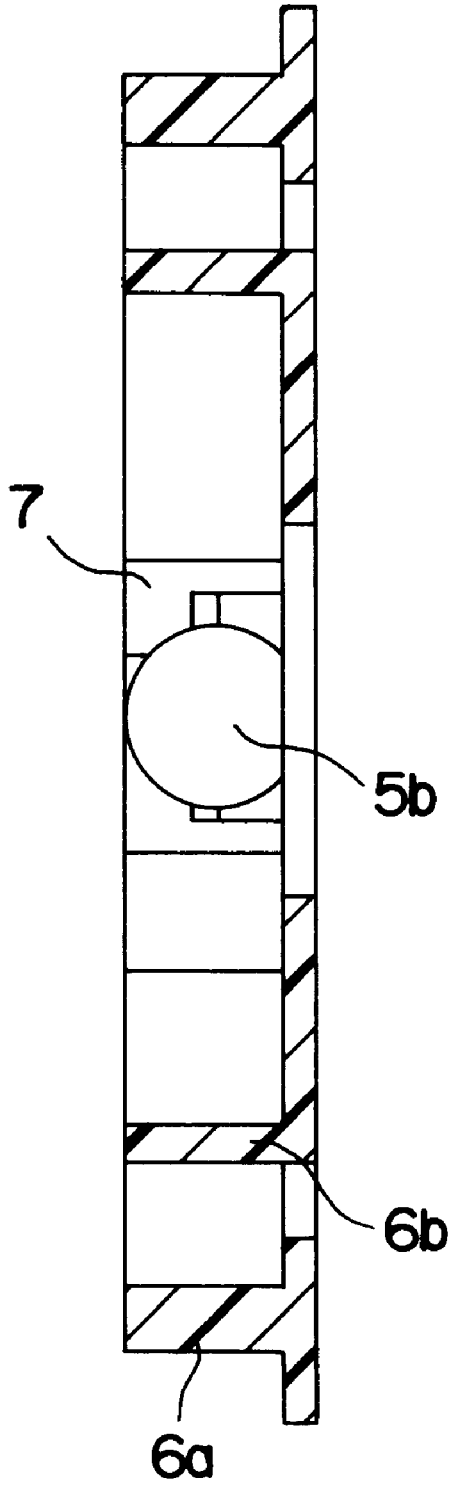
FIG. 9 is a sectional view of the proximal body of the switch.
Figure 10:
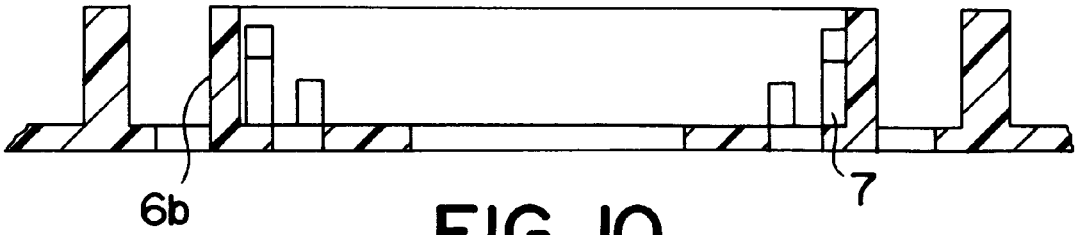
FIG. 10 is a sectional view of the proximal body of a switch.
Figure 11:
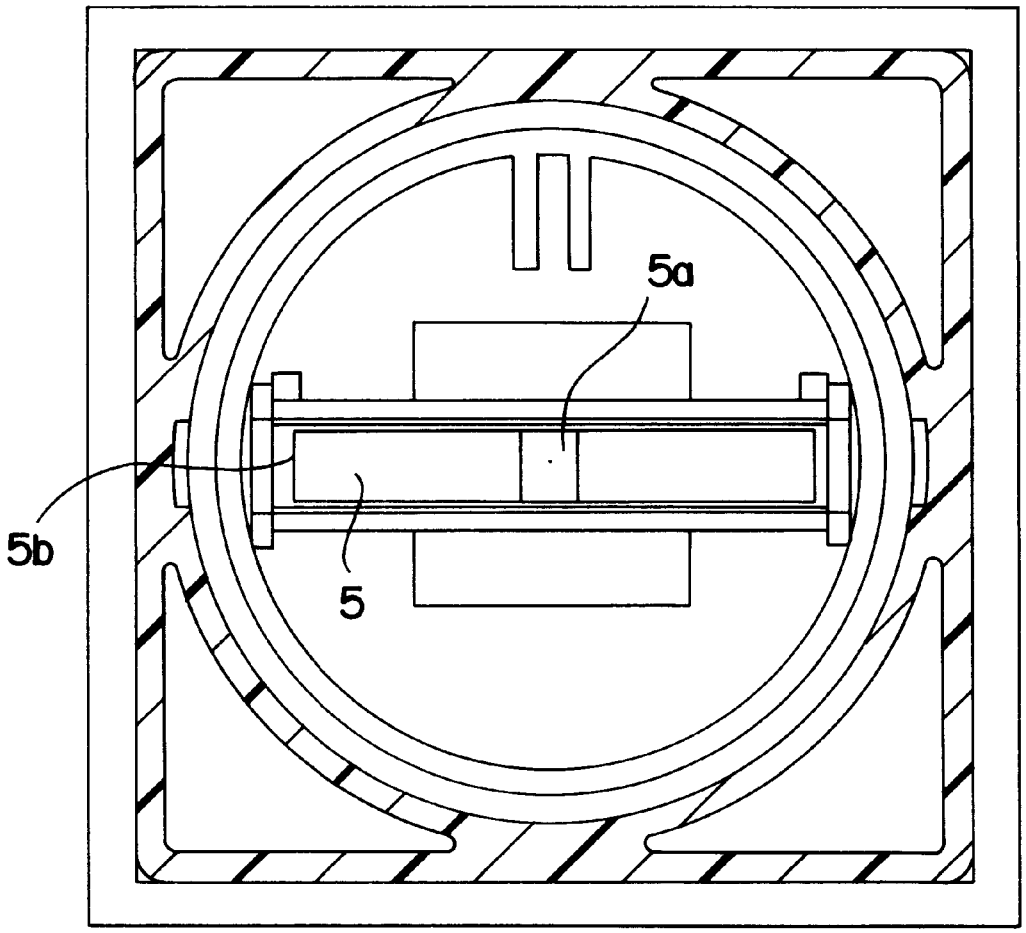
FIG. 11 is a sectional view of the proximal body of the switch.
Figure 12:
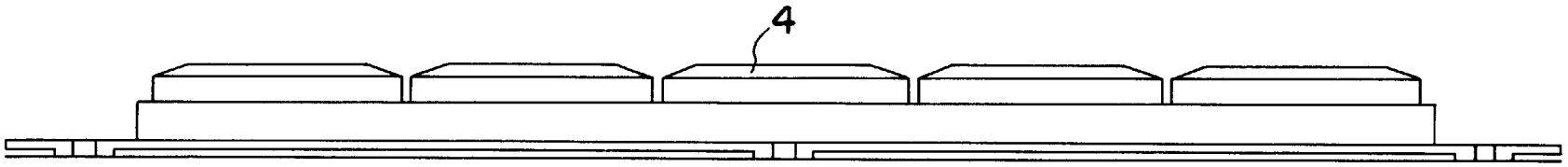
FIG. 12 is a side view of the switch.
Figure 13:
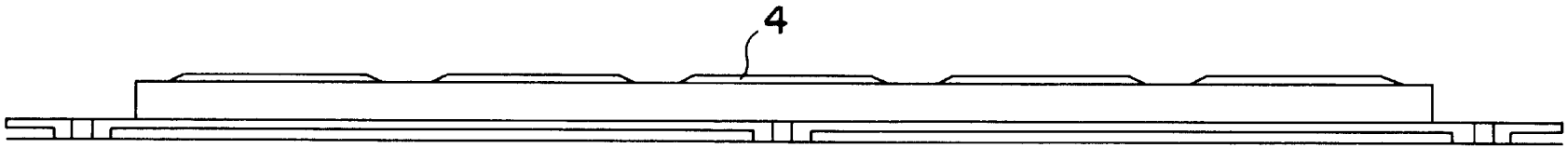
FIG. 13 is a side view of the switch.
Figure 14:
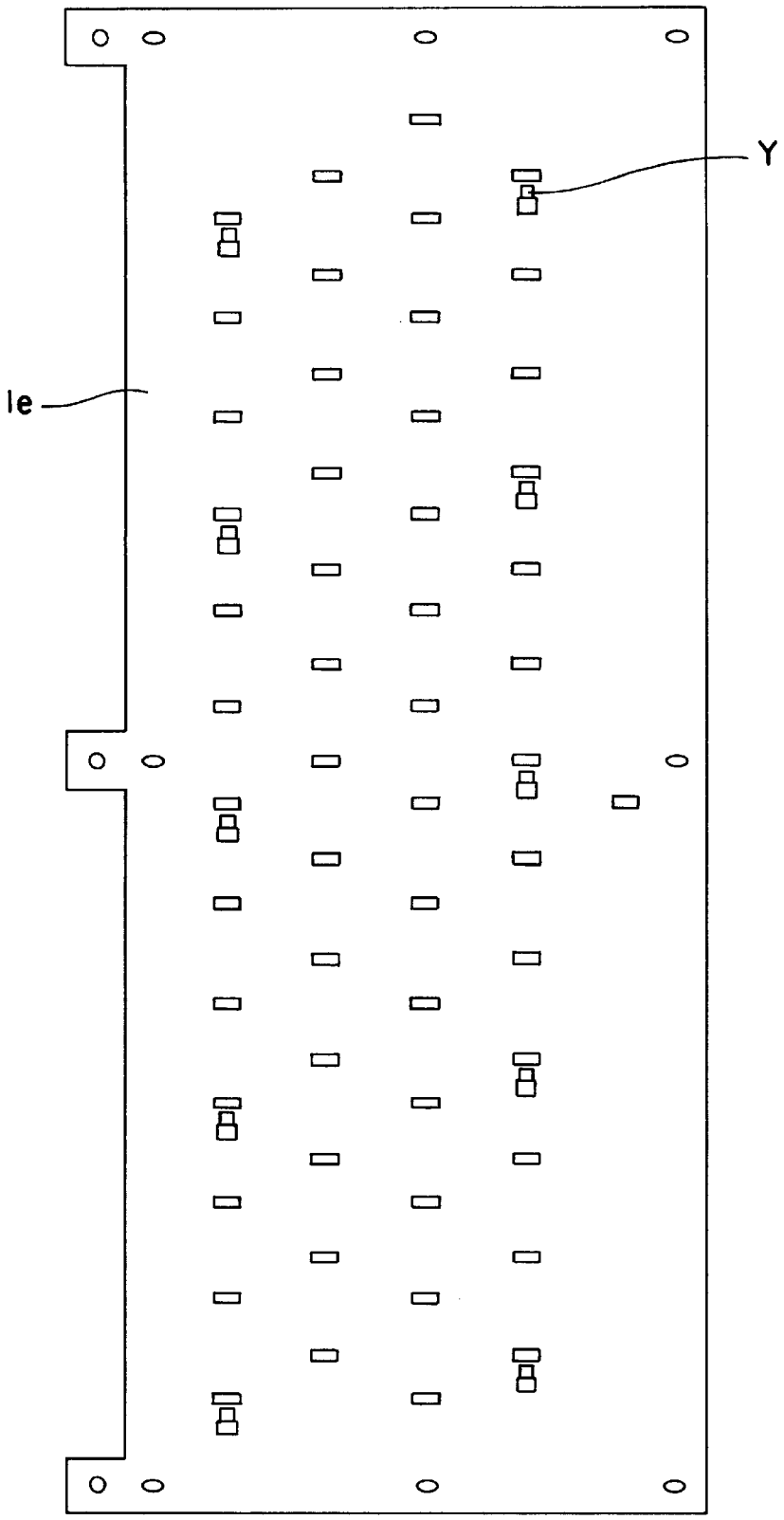
FIG. 14 is a top plan view of a driving board.

As shown in FIG. 2 a cylindrical pivotal axis 5*b* having a series of tooth-shaped convexities x in the outer periphery at the lower part of the repulsive spring 5 is integrally molded, this pivotal axis 5 is pivotally secured about the pivotal axis to a securing housing 7 erected on the proximal body as shown in FIG. 9.

Figure 3:
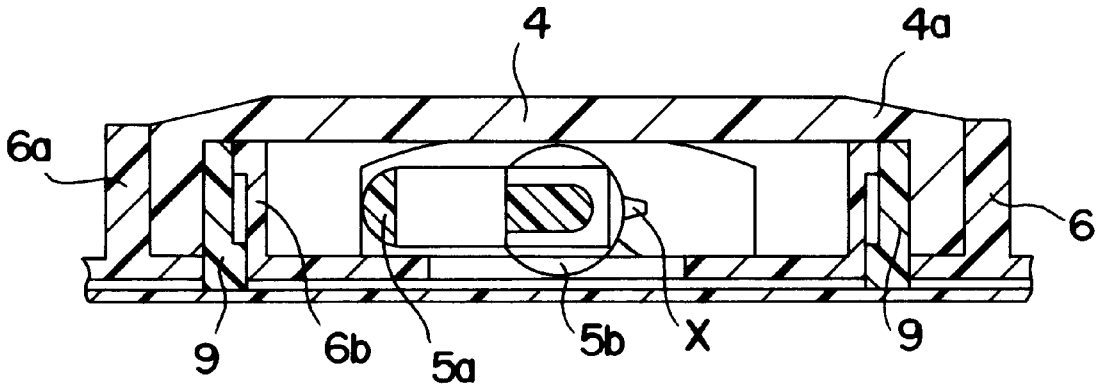
FIG. 3 is a sectional view of the switch according to the embodiment.
Figure 4:
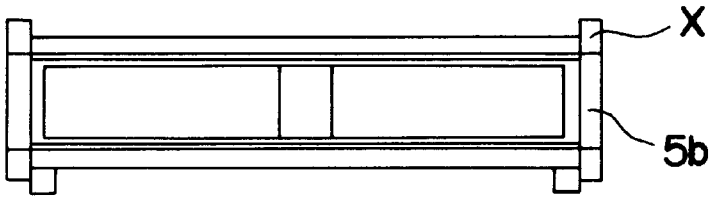
FIG. 4 is a top view of a repulsive spring.
Figure 5:
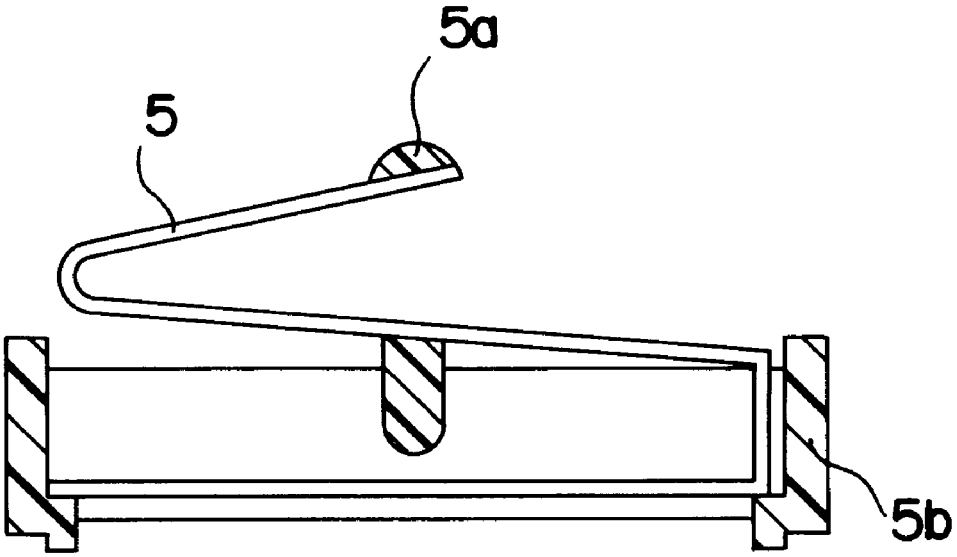
FIG. 5 is a sectional view of the repulsive spring.
Figure 6:
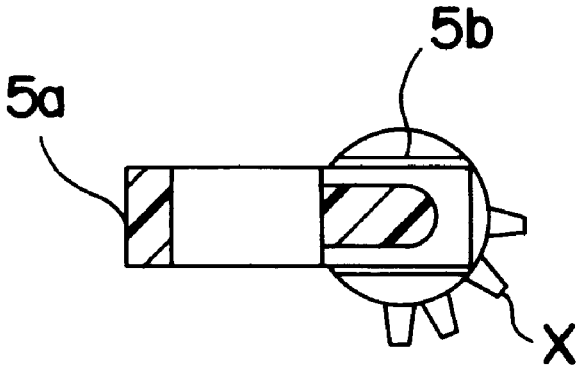
FIG. 6 is a sectional view of the repulsive spring.
Figure 7:
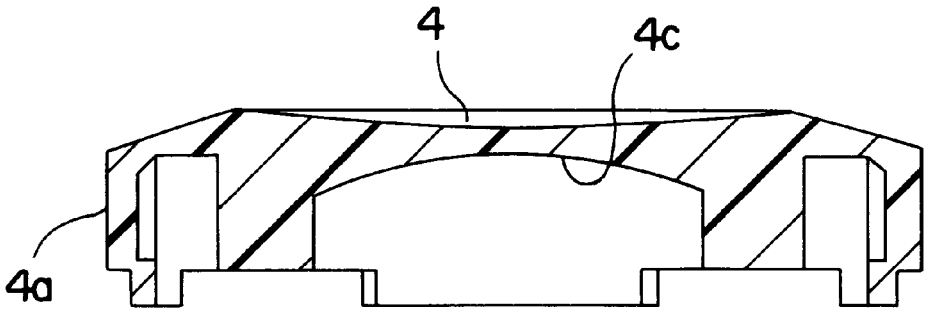
FIG. 7 is a sectional view of a key top.
Figure 8:
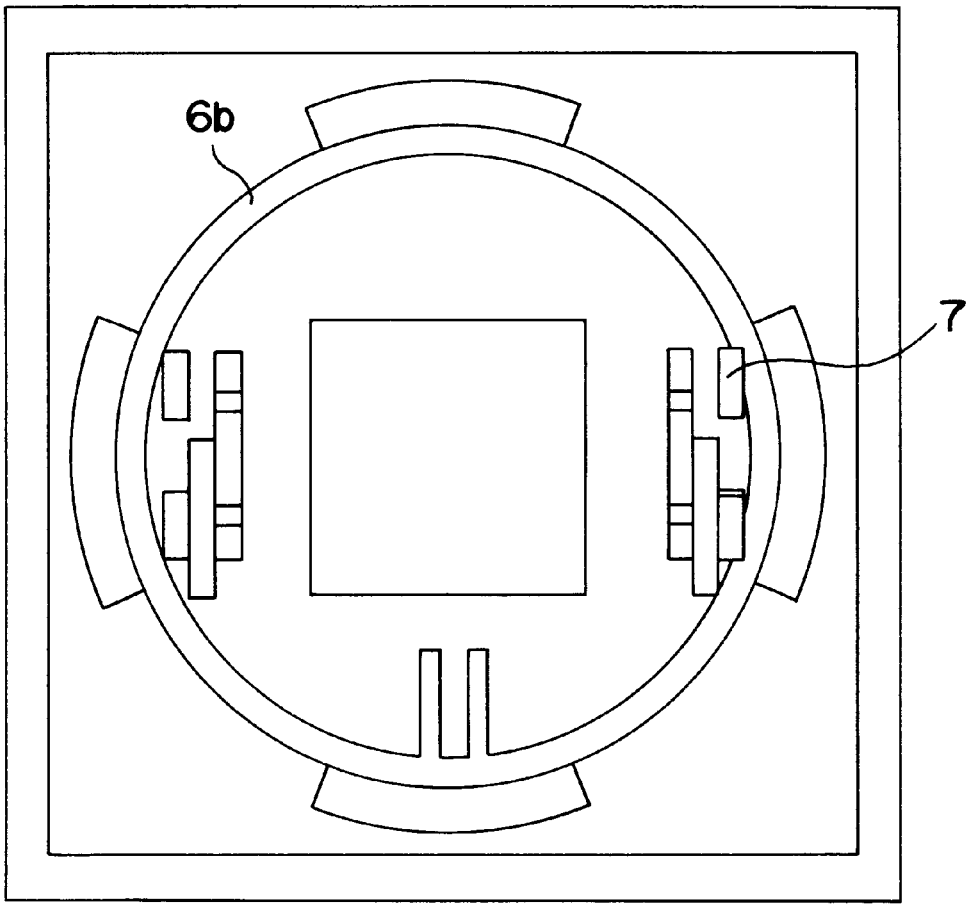
FIG. 8 is a top view of a proximal body of the switch.

In the above-mentioned structure, a concave Y of a driving board 1*c* attached to the lower part is formed to be engaged with a groove X of the pivotal axis 5*b*, whereby the repulsive spring 5 is pivoted according to the horizontal shift of the driving board 1*c*. That is, in a state shown in FIG. 1 and FIG. 2 the repulsive spring 5 pushes up the key top 4, however as shown in FIG. 3 when the driving board 1*c* is shifted in a horizontal direction, the pivotal axis 5*b* of the repulsive spring 5 rotates and the extreme end of the protrusion 5*a* is separated from the key top 4 and the key top 4 falls due to its own weight.

Incidentally, it is preferable to form a spherical surface 4*c* on the inner peripheral surface of the key top 4 for facilitating the smooth action with the extreme end of the elastic material 5 that is the protrusion 5*a*.

Figure 15:
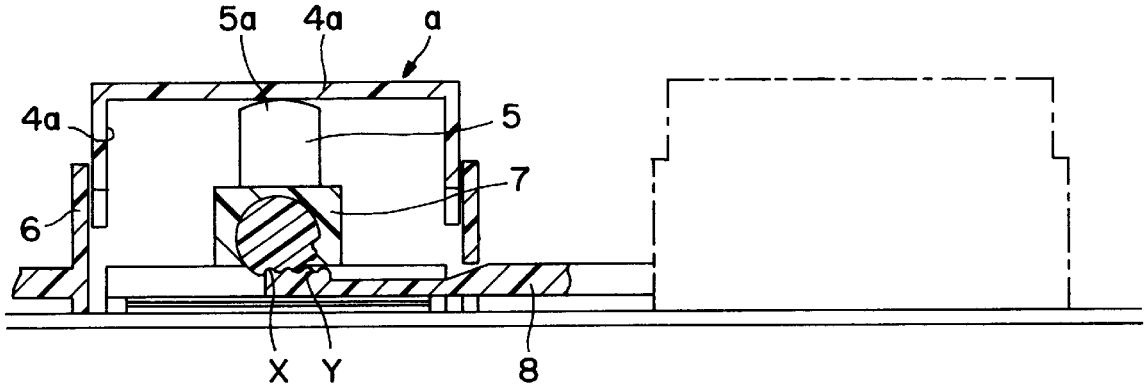
FIG. 15 is a sectional view of another embodiment of the switch of the present invention.

The key top 4 according to the embodiment in FIG. 15 is formed as a cap shape body having the side wall 4*a*, covers in the inner peripheral surface of a supporting wall 6 erected from the proximal body, and is movably supported in a vertical direction. On the other hand, the repulsive spring 5 is formed as an elastic part, has the protrusion 5*a* at the extreme end around the center, and allows the extreme end of the protrusion 5*a* to abut against the back face of the key top 4 to push up to the maximum height.

Further, a cylindrical pivotal axis 5*b* having grooves X in the outer periphery is formed at the lower part of the repulsive spring 5 and pivotally secured about the pivotal axis to a securing housing 7 in which the pivotal axis 5*b* is erected on the proximal body.

Figure 16:
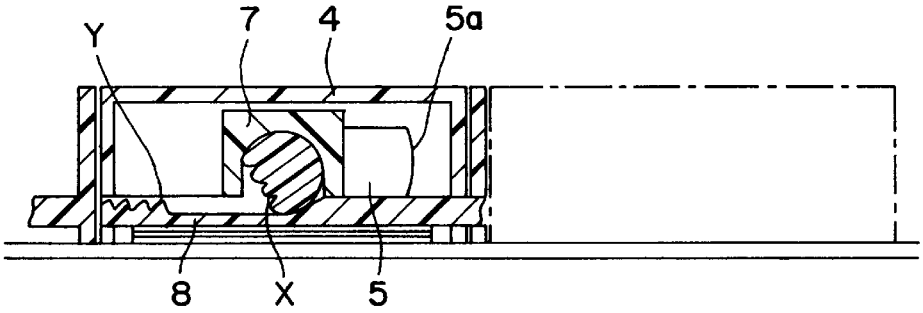
FIG. 16 is a section view of the switch of FIG. 15 actuated.

The present invention in the above-mentioned structure is formed to engage a projection Y of an extreme end of a driving board 1*e* mounted to extend from the adjacent key top 4 with a groove X of the pivotal axis 5*b*, whereby the repulsive spring 5 is pivoted according to the distance of the adjacent key top 4 in a horizontal direction. That is, as shown in FIG. 15 when the adjacent key top 4 is separated, the repulsive spring pushes up the key top 4, however as shown in FIG. 16 when the key top 4 approaches, the repulsive spring 5 is separated from the key top 4 and the key top 4 falls due to its own weight.

Figure 17:
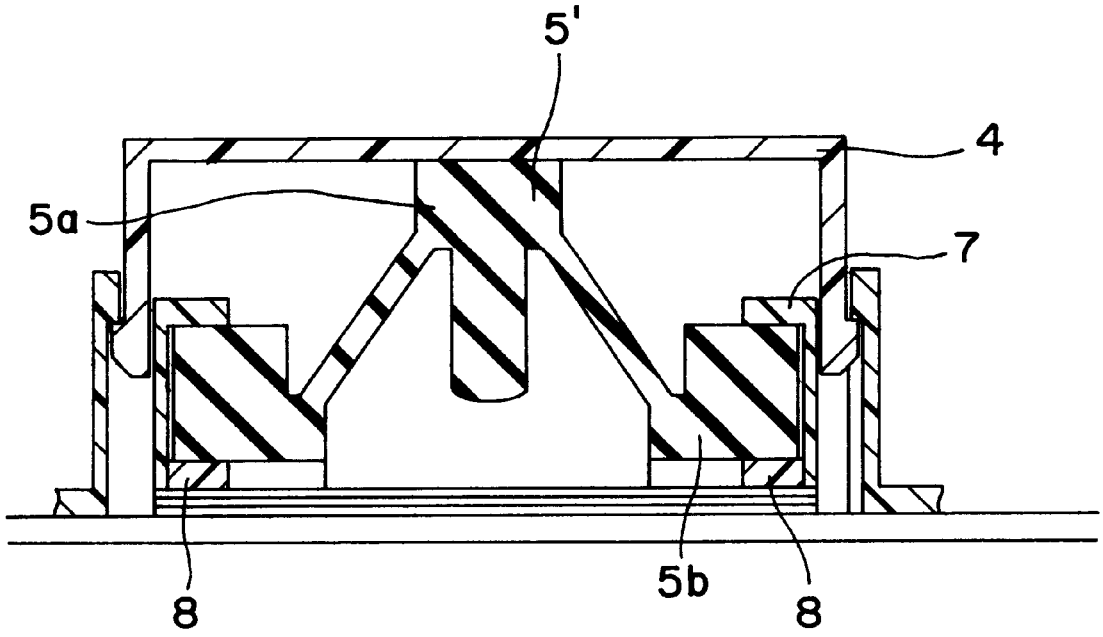
FIG. 17 is a sectional view of another embodiment of the present invention.

The key top 4 according to the embodiment shown in FIG. 17 is formed as a cap shape body having the side wall 4*a*, covers in inner peripheral surface of the supporting wall 6 erected from the proximal wall, and is movably supported in the vertical direction. On the other hand, the repulsive spring 5' is formed as an elastic part and its elasticity pushes the key top 4.

Figure 18:
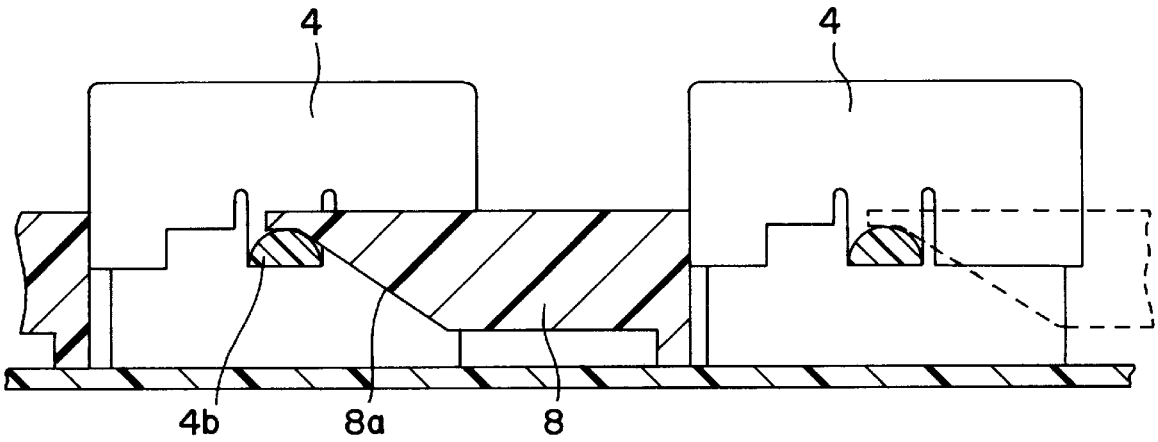
FIG. 18 and 19 are sectional views showing another embodiments of the switch of the present invention in the open end actuated state, respectively.
Figure 19:
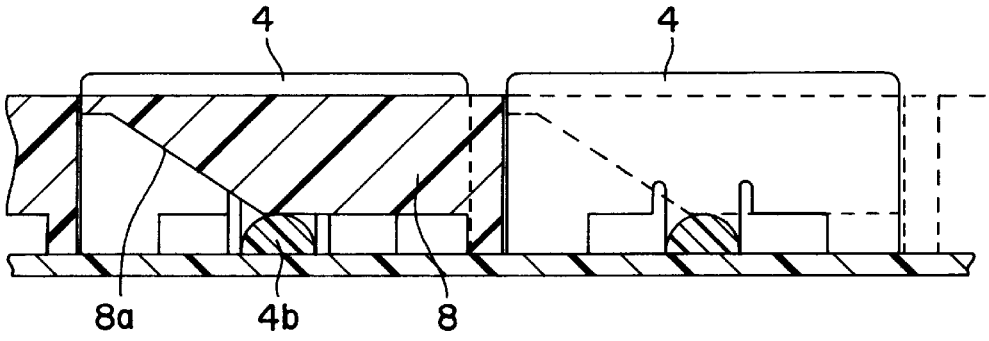
Figure 20:
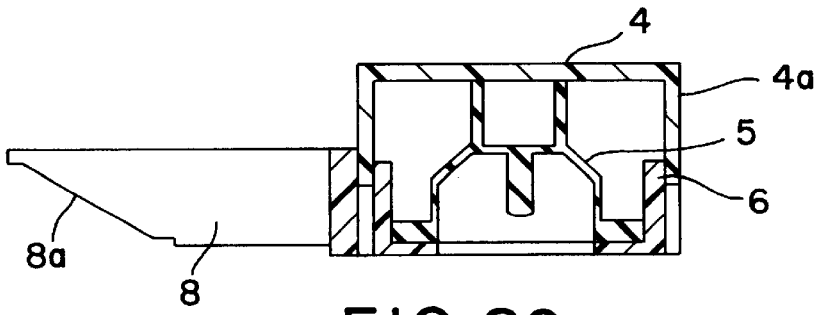
FIG. 20 is a partial sectional view of FIG. 18.
Figure 21:
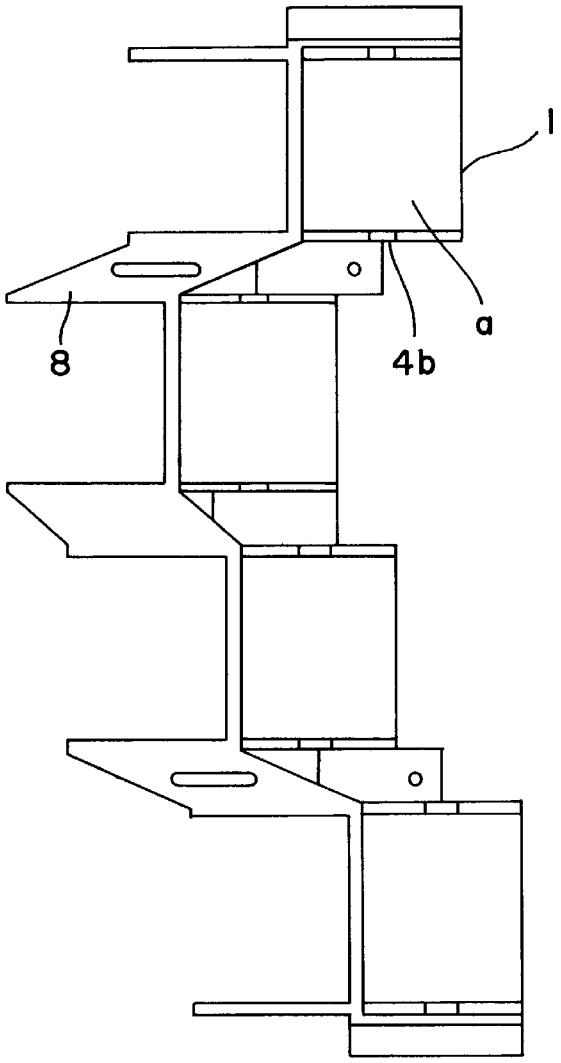
FIG. 21 is a top view of FIG. 18.
Figure 22:
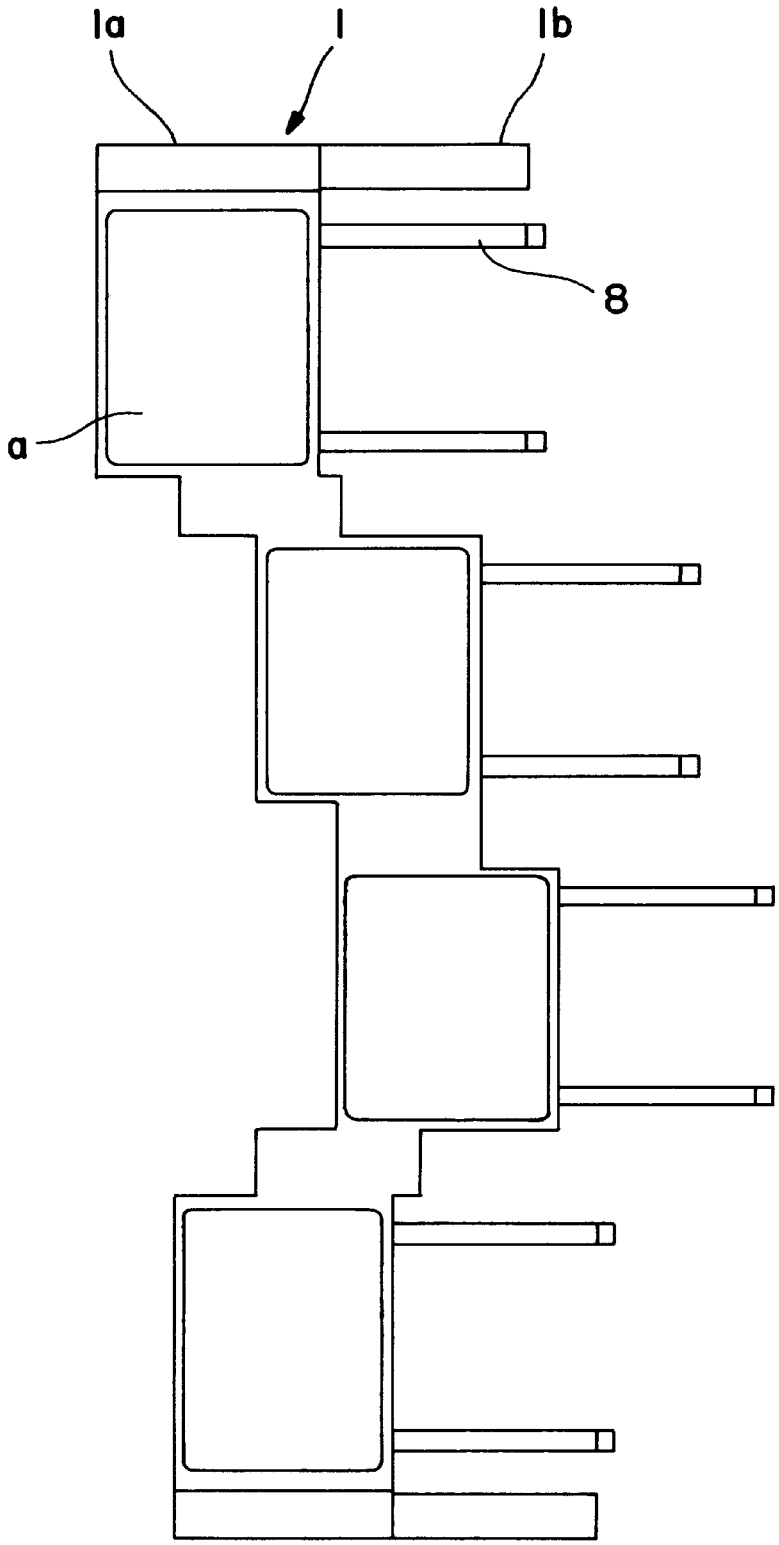
FIG. 22 is a top view of FIG. 15.

Further, as shown in FIG. 18 the protrusion 4*b* is formed on one side edge in the front direction of the figure in the outer periphery of the key top 4, and a driving board 8 is formed with a taper surface 8*a* at the extreme end thereof on one side edge in the outer periphery of the key top 4 in the side direction of the figure.

Figure 1:
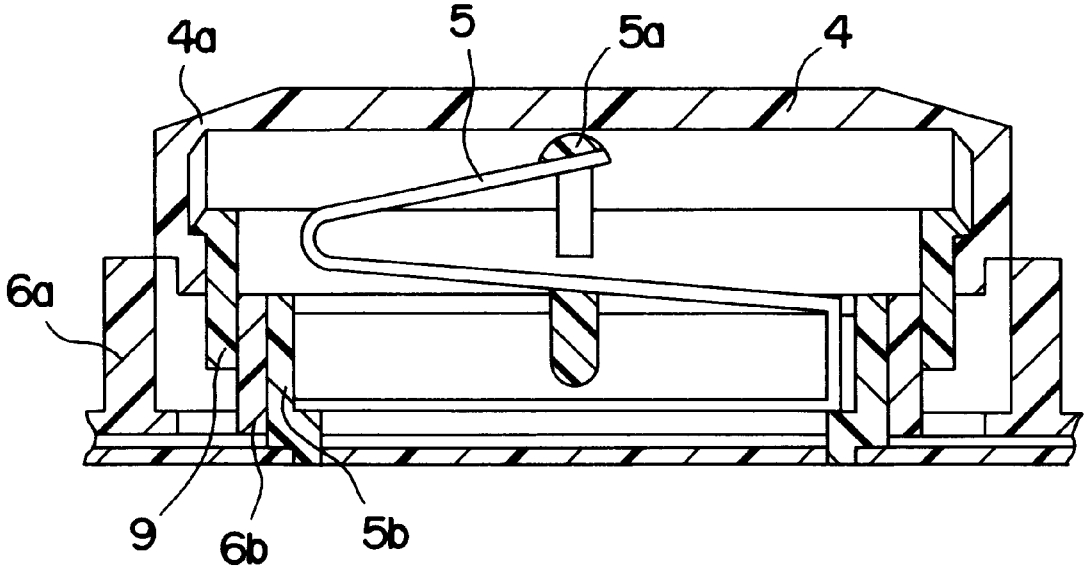
FIG. 1 is a sectional view of a switch according to an embodiment.

The protrusion 4*b* of the key top 4 and the taper surface 8*a* of the driving board 8 are formed to abut, whereby the key top 4 is pushed up according to the distance of the adjacent key top 4 in the horizontal direction. That is, as shown in FIG. 18 when the adjacent key top 4 is separated the repulsive spring 5' pushes up the key top 4, however as shown in FIG. 1 when the adjacent key top 4 approaches, the taper surface 8*a* of the driving board 8 of the adjacent key top 4 presses down the protrusion 4*b* of the key top 4 to shift the key top 4 downwardly.

What is claimed is:

1. A volume variable type switch structure comprising at least two adjacent switches wherein each of said switches comprises a key top, a lower contact, a repulsive spring provided between said key top and said lower contact, and a shifting means for shifting said repulsive spring such that the key tops and the repulsive springs are respectively separated to allow the key tops fall due to the key tops' weight; and said shifting means comprises horizontally shiftingly providing said switches and a driving board is provided to extend from each of the adjacent switches which causes said repulsive springs to separate from said respective key tops when each of said adjacent switches is shifted.

2. The volume variable type switch structure according to claim 1 wherein a spherical protrusion is provided at an upper end of each of said repulsive springs.

3. The volume variable type switch structure according to claim 2 wherein a bent surface to guide a smooth movement surface of said spherical protrusion at an upper end of each of said repulsive springs formed on a back face of the respective key tops.

4. The volume variable type switch structure according to claim 1 further comprising a housing member, a smooth movement surface is erected for butting against a wall surface hanging down from the key tops and for supporting an upward and downward movement of the key tops on an proximal body.

5. The volume variable type switch structure according to claim 4 further comprising a side wall of an intermediate member inserted between said wall surface of the housing member erected from the proximal body on said smooth movement surface and the wall hanging down from the key tops.

6. A volume variable type switch structure comprising at least two adjacent switches wherein each of said switches comprises a key top, a lower contact, a repulsive spring provided between said key top and said lower contact, and a shifting means for shifting said repulsive spring such that the key tops and the repulsive springs are respectively separated to allow the key tops to fall due to the key tops' weight; and each of said repulsive springs are provided with a protrusion which upwardly abuts against a lower surface of the respective key tops to support said key tops in a vertical direction and has a pivot mounting portion at a lower part, whereby when said pivot mounting portion rotates about a pivotal axis by action of said shifting means, the protrusion and the lower surface of the respective key tops are separated to allow the key tops to fall due to said key tops' weight.

7. The volume variable type switch structure according to claim 6 wherein each of said repulsive springs comprises a board having a substantially Z-shape and having elasticity and said pivot mounting portion is integrally molded at a lower part of said board.

8. The volume variable type switch structure according to claim 6 wherein said pivot mounting portion is a cylindrical member rotatable about said pivotal axis.

9. The volume variable type switch structure according to claim 8 wherein the cylindrical member of said pivot mounting portion rotates about said pivotal axis by cooperation with a movable member having a convex portion provided in an outer periphery and a concave portion for engaging with said convex portion.

10. A volume variable type switch structure comprising at least two adjacent switches wherein each of said switches comprises a key top, a lower contact, a repulsive spring provided between said key top and said lower contact, and a means for pressing said key top to press the key top downward; and wherein each of said adjacent switches is horizontally shiftable; and said pressing means comprises a protrusion provided in an outer periphery of each of said key tops and a driving board extending from each of the adjacent switches and engaging with said protrusion whereby said key tops are pushed down when each of the adjacent switches is shifted.

* * * * *